US006932094B2

(12) United States Patent
Chen et al.

(10) Patent No.: US 6,932,094 B2
(45) Date of Patent: Aug. 23, 2005

(54) SLURRY TANK AUTOCLEANER

(75) Inventors: Chih-Kun Chen, Bade (TW); Ming Fa Tsai, Panchiao (TW)

(73) Assignee: Nanya Technology Corporation, Taoyuan (TW)

( * ) Notice: Subject to any disclaimer, the term of this patent is extended or adjusted under 35 U.S.C. 154(b) by 231 days.

(21) Appl. No.: 10/313,176

(22) Filed: Dec. 6, 2002

(65) Prior Publication Data

US 2003/0201002 A1 Oct. 30, 2003

(30) Foreign Application Priority Data

Apr. 29, 2002 (TW) ..... 91205895 U

(51) Int. Cl.[7] ..... B08B 3/02

(52) U.S. Cl. ..... 134/56 R; 134/95.2; 134/168 R; 134/170

(58) Field of Search ..... 134/56 R, 95.1, 134/95.2, 166 R, 168 R, 170, 199

(56) References Cited

U.S. PATENT DOCUMENTS 1,400,797 A * 12/1921 Burnham ..... 134/167 R
1,799,525 A * 4/1931 Gomar ..... 134/167 R
2,199,747 A * 5/1940 Long et al. ..... 134/9
2,967,531 A * 1/1961 Nussbaum ..... 134/95.3
3,078,861 A * 2/1963 Miller ..... 134/96.1
3,476,600 A * 11/1969 Selmeczi et al. ..... 134/10
3,530,864 A * 9/1970 Wright ..... 134/58 D
3,587,597 A * 6/1971 Courtney et al. ..... 134/95.2
3,664,335 A * 5/1972 Boucher et al. ..... 128/206.19
3,688,782 A * 9/1972 Smith ..... 134/58 R
3,856,572 A * 12/1974 Hildebrand ..... 134/96.1
4,133,340 A * 1/1979 Ballard ..... 134/112
4,842,001 A * 6/1989 O'Leary ..... 134/112
5,220,933 A * 6/1993 Albers ..... 134/58 R
5,232,299 A * 8/1993 Hiss ..... 401/143
5,288,601 A * 2/1994 Greener et al. ..... 430/533
5,482,064 A * 1/1996 Goddard ..... 134/57 R
5,961,937 A * 10/1999 Gobbato ..... 422/300
6,276,373 B1 * 8/2001 Gotfried ..... 134/22.1
6,558,620 B1 * 5/2003 Sanford et al. ..... 422/28
2004/0123885 A1 * 7/2004 Myong ..... 134/168 R

* cited by examiner

*Primary Examiner*—Frankie L. Stinson
(74) *Attorney, Agent, or Firm*—Quintero Law Office

(57) ABSTRACT

A slurry tank autocleaner for cleaning an empty slurry tank. A first pipe is inserted in the interior of the slurry tank, where the first pipe has an open end located inside the slurry tank. A first nozzle is disposed on the open end of the first pipe. A cover is used to cover the slurry tank, where the cover has a plurality of second nozzles targeting the slurry tank. A second pipe is connected to the second nozzles. A controller is used to control chemical, pure water or dry gas to spurt from the first nozzle and the second nozzles through the first pipe and the second pipe. Thus, the slurry tank can be automatically cleaned.

12 Claims, 2 Drawing Sheets

SLURRY TANK AUTOCLEANER

BACKGROUND OF THE INVENTION

1. Field of the Invention

The present invention relates to an apparatus for a polishing process, and more particularly, to an apparatus for automatically cleaning a slurry tank.

2. Description of the Related Art

Unevenness of wafer surface is a serious problem, due to the high-integration and multiple layer structure of the circuit distribution of semiconductor devices. Therefore, in order to planarize or flatten uneven wafer surface, chemical-mechanical polishing (CMP) techniques are commonly used.

Cleaning slurry tanks is important for effective CMP. Variables such as slurry residue, dregs, dirty particles, and so on, greatly affect uniformity. These also seriously affect the pH of the slurry and its ion concentration, thereby decreasing manufacturing yield.

Conventionally, slurry tanks are cleaned by hand. However, it is difficult, messy, and ineffective to clean the slurry tank with this method, as well as frequently unsafe.

SUMMARY OF THE INVENTION

An object of the present invention is to provide a novel slurry tank autocleaner.

Another object of the present invention is to provide a slurry tank autocleaner having wet cleaning and drying functions.

To achieve these objects, the present invention provides a slurry tank autocleaner. A frame has at least a first opening, a second opening, a third opening, a fourth opening and a fifth opening, wherein the fourth opening faces up. A cover is disposed on the frame and covers the fourth opening, wherein the cover has at least a first nozzle, a second nozzle and a third nozzle. A first pipe is disposed around the cover and connects the first nozzle, the second nozzle and the third nozzle. A container is disposed in the frame and is located below the fourth opening, wherein the bottom of the container has a sixth opening. A chemical supply means is disposed in the frame, wherein the chemical supply means has a chemical supply pipe and a chemical recycling pipe. A first air valve is disposed in the frame and connects the chemical supply pipe. A second air valve is disposed in the frame and connects the first air valve by means of a second pipe. A pure water pipe connects a pure water source and the second air valve through the first opening. A first gas pipe connects a first gas source and the second air valve through the second opening. A third pipe has a first open end, a second open end and a third open end. The first open end connects the first valve, the second open end is located above the third opening and connects the first pipe, and the third open end is located above the fourth opening. A fourth nozzle is disposed on the third end of the third pipe. A third air valve is disposed in the frame and connects the sixth opening of the container by means of a fourth pipe. A fifth pipe connects the third air valve and the chemical recycling pipe. A sixth pipe connects the third air valve and a drain system through the fifth opening. A controller controls the movement of the first air valve by means of a first controlling line, the movement of the second air valve by means of a second controlling line and the movement of the third air valve by means of a third controlling line.

The present invention improves on the prior art in that the slurry tank autocleaner of the present invention uses the controller to control chemical, pure water or dry gas to spurt from the nozzles through the pipes. Thus, the present invention can automatically clean the slurry tank, thereby saving manpower, reducing costs and improving worker safety. Additionally, the present invention has a chemical recycling function, thereby saving chemical consumption while ameliorating the disadvantages of the prior art.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE INVENTION

Figure 1:
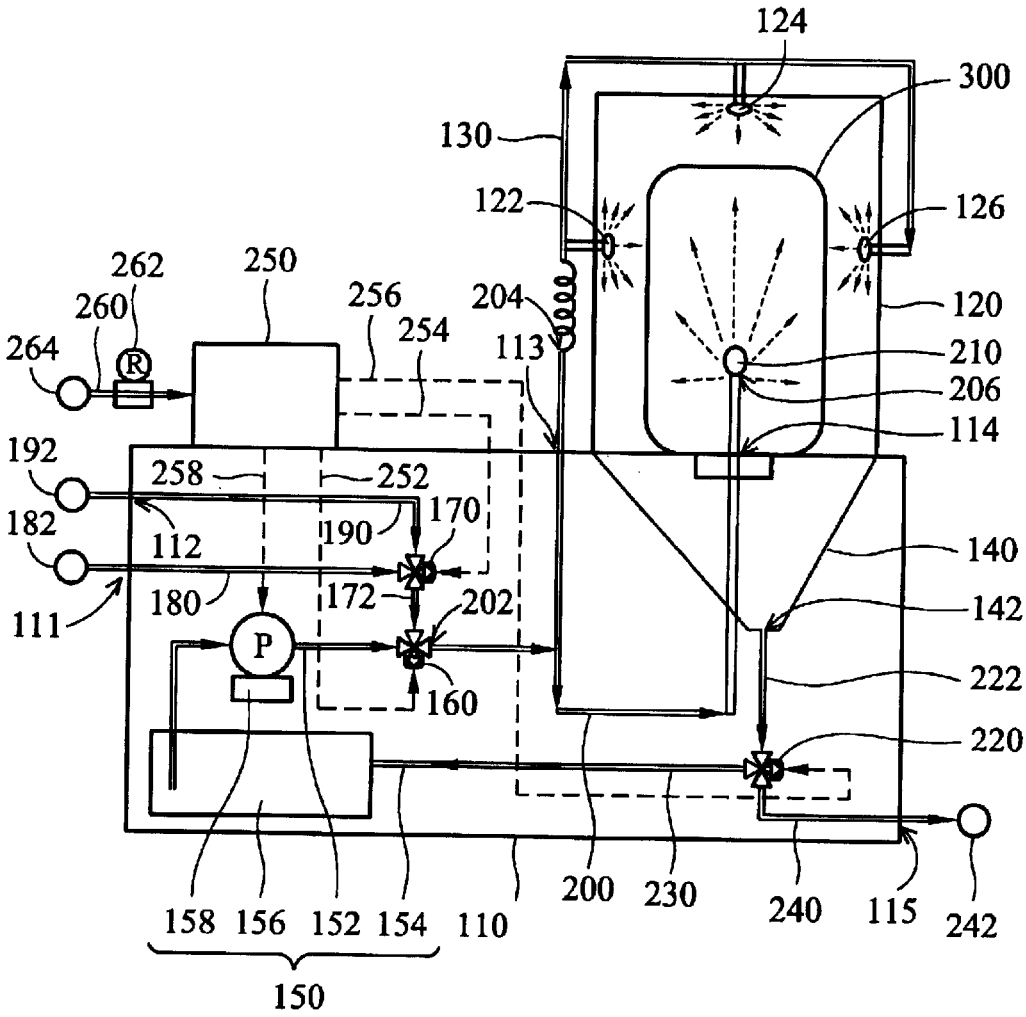
FIG. 1 is a sectional view of the slurry tank autocleaner of the present invention.

A slurry tank autocleaner of the embodiment is shown with reference to FIG. 1. FIG. 1 is a sectional view of the slurry tank autocleaner in the embodiment of the present invention.

In FIG. 1, the slurry tank autocleaner for automatically cleaning an empty slurry tank 300 is provided. A frame 110 has at least a first opening 111, a second opening 112, a third opening 113, a fourth opening 114 and a fifth opening 115, wherein the fourth opening 114 faces up. Moreover, the frame 110 has mesh (screen holes, not shown) around the fourth opening 114, through which liquid can pass.

In FIG. 1, a cover 120 is disposed on the frame 110 and covers the fourth opening 114. The cover has at least a first nozzle 122, a second nozzle 124 and a third nozzle 126. Moreover, the direction of the nozzles 122, 124, 126 is toward the surface of the slurry tank 300.

In FIG. 1, a first pipe 130 is disposed around the cover 120 and connects the first nozzle 122, the second nozzle 124 and the third nozzle 126.

In FIG. 1, a container 140 serving as a collector is disposed in the frame 110 and below the fourth opening 114. The bottom of the container 140 has a sixth opening 142.

In FIG. 1, a chemical supply means 150 is disposed in the frame 110. The chemical supply means 150 has a chemical supply pipe 152 and a chemical recycling pipe 154. Moreover, the chemical supply means 150 includes a chemical tank 156 and a pump 158. The chemical tank 156 is used to store chemical, such as cleaning compounds, and connects the chemical supply pipe 152 and the chemical recycling pipe 154. The pump 158 is disposed in line with the chemical supply pipe 152.

In FIG. 1, a first air valve 160 is disposed in the frame 110 and connects the chemical supply pipe 152. The first air valve 160 can be a three way air valve.

In FIG. 1, a second air valve 170 is disposed in the frame 110 and connects the first air valve 160 by means of a second pipe 172. The second air valve 170 can be a three way air valve.

In FIG. 1, a pure water pipe 180 connects a pure water source 182 and the second air valve 170 through the first opening 111.

In FIG. 1, a first gas pipe 190 connects a first gas source 192 and the second air valve 170 through the second opening 112. The first gas source 192 can be a nitrogen gas source or a compressed dry air (CDA) source.

In FIG. 1, a third pipe 200 has a first open end 202, a second open end 204 and a third open end 206. The first open end 202 connects the first valve 160. The second open end 204 is located above the third opening 113 and connects the first pipe 130. The third open end 206 is located above the fourth opening 114; meanwhile, the third open end 206 is located in the slurry tank 300.

In FIG. 1, a fourth nozzle 210 is disposed on the third open end 206 of the third pipe 200 and in the slurry tank 300.

In FIG. 1, a third air valve 220 is disposed in the frame 110 and connects the sixth opening 142 of the container 140 by means of a fourth pipe 222. The third air valve 220 can be a three way air valve.

In FIG. 1, a fifth pipe 230 connects the third air valve 220 and the chemical recycling pipe 154.

In FIG. 1, a sixth pipe 240 connects the third air valve 220 and a drain system 242 through the fifth opening 115.

In FIG. 1, a controller 250 is used to control the movement of the first air valve 160, the second air valve 170 and the third air valve 220. For example, the controller 250 controls the first air valve 160 by means of a first controlling line 252. The controller 250 controls the second air valve 170 by means of a second controlling line 254. The controller 250 controls the third air valve 220 by means of a third controlling line 256. Moreover, the controller 250 can control the movement of the pump 158 by means of a fourth controlling line 258. The controlling lines 252, 254, 256, 258 can be air lines. In addition, the controller 250 can include a programmable controller (PLC) or relay in order to set up the cleaning process.

In FIG. 1, a second gas pipe 260 connects the controller 250 and a second gas source 264. The second gas pipe preferably has a regulator 262. The second gas source 264 can be a compressed dry air source.

As an application of the present invention, referring to FIG. 1, the empty slurry tank 300 is placed upside down on the frame 110 and the fourth nozzle 210 is located in the slurry tank 300. Then, the cover 120 covers the slurry tank 300, and the controller 150 is switched on to perform an auto cleaning procedure on the slurry tank 300. In FIG. 1, for example, the controller 150 controls chemical, pure water or CDA to spray on the slurry tank 300 from the nozzles 122, 124, 126, and 210. The chemical and pure water flow to the container 140, then to the drain system 242. Also, the chemical can be recycled to the chemical tank 156 according to the movement of the third air valve 220.

Figure 2:
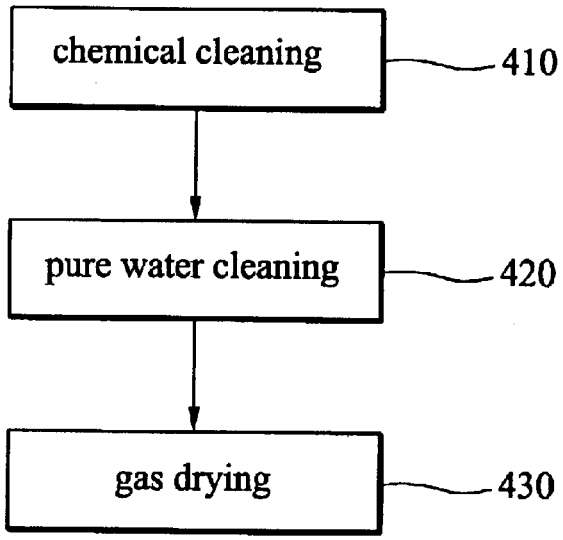
FIG. 2 is a flow chart illustrating a demonstrative operation flow of the present invention.

FIG. 2 shows a flow chart illustrating a demonstrative operation flow of the present invention. Using an installed program in the controller 150, the slurry tank 300 is automatically cleaned with the slurry tank autocleaner. For example, a step 410 of chemical cleaning is performed. Then, a step 420 of pure water cleaning is performed. And then, a step 430 of gas drying is performed. In addition, during the chemical cleaning step 410, the chemical can be recycled to the chemical tank 156 through the fourth pipe 222, the fifth pipe 230 and the chemical recycling pipe 154.

Thus, the present invention can automatically clean the slurry tank, thereby saving manpower, reducing costs and improving worker safety. Additionally, the present invention has a chemical recycling function, thereby saving chemical consumption while ameliorating the disadvantages of the prior art.

Finally, while the invention has been described by way of example and in terms of the above, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A slurry tank autocleaner, comprising:

a frame having at least a first opening, a second opening, a third opening, a fourth opening and a fifth opening, wherein the fourth opening faces up;

a cover disposed on the frame and covering the fourth opening, wherein the cover has at least a first nozzle, a second nozzle and a third nozzle;

a first pipe disposed around the cover and connecting the first nozzle, the second nozzle and the third nozzle;

a container disposed in the frame and below the fourth opening, wherein the bottom of the container has a sixth opening;

a chemical supply means disposed in the frame, wherein the chemical supply means has a chemical supply pipe and a chemical recycling pipe;

a first air valve disposed in the frame and connecting the chemical supply pipe;

a second air valve disposed in the frame and connecting the first air valve by means of a second pipe;

a pure water pipe connecting a pure water source and the second air valve through the first opening;

a first gas pipe connecting a first gas source and the second air valve through the second opening;

a third pipe having a first open end, a second open end and a third open end, wherein the first open end connects the first valve, the second open end is located above the third opening and connects the first pipe, and the third open end is located above the fourth opening;

a fourth nozzle disposed on the third open end of the third pipe;

a third air valve disposed in the frame and connecting the sixth opening of the container by means of a fourth pipe;

a fifth pipe connecting the third air valve and the chemical recycling pipe;

a sixth pipe connecting the third air valve and a drain system through the fifth opening; and a controller for controlling the movement of the first air valve by means of a first controlling line, the movement of the second air valve by means of a second controlling line and the movement of the third air valve by means of a third controlling line.

2. The slurry tank autocleaner according to claim 1, wherein the chemical supply means further comprises:

a chemical tank for storing chemical, wherein the chemical tank connects the chemical supply pipe and the chemical recycling pipe; and a pump disposed on the way of the chemical supply pipe.

3. The slurry tank autocleaner according to claim 2, wherein the controller controls the movement of the pump by means of a fourth controlling line.

4. The slurry tank autocleaner according to claim 1, wherein the frame has mesh around the fourth opening.

5. The slurry tank autocleaner according to claim 1, further comprising:

a second gas pipe connecting the controller and a second gas source, wherein the second gas pipe has a regulator.

6. The slurry tank autocleaner according to claim 5, wherein the second gas source is a compressed dry air (CDA) source.

7. The slurry tank autocleaner according to claim 1, wherein the first air valve is a three way air valve.

8. The slurry tank autocleaner according to claim 1, wherein the second air valve is a three way air valve.

9. The slurry tank autocleaner according to claim 1, wherein the third air valve is a three way air valve.

10. The slurry tank autocleaner according to claim 1, wherein the first gas source is a nitrogen gas source or a compressed dry air (CDA) source.

11. The slurry tank autocleaner according to claim 1, wherein the controller comprises a programmable controller (PLC).

12. The slurry tank autocleaner according to claim 1, wherein the controller comprises a relay.

* * * * *